US005902721A

United States Patent [19]

Becher et al.

[11] Patent Number: 5,902,721

[45] Date of Patent: May 11, 1999

[54] REDUCED DEVELOPMENT TIME COLOR NEGATIVE PROCESS AND PROCESS COMPATIBLE COLOR NEGATIVE ELEMENTS

[75] Inventors: John H. Becher, Webster; Roger A. Bryant, Rochester, both of N.Y.

[73] Assignee: Eastman Kodak Company, Rochester, N.Y.

[21] Appl. No.: 09/024,335

[22] Filed: Feb. 17, 1998

[51] Int. Cl.[6] ..... G03C 1/09

[52] U.S. Cl. ..... 430/541; 430/374; 430/375; 430/376; 430/542; 430/543; 430/604; 430/605

[58] Field of Search ..... 430/541, 542, 430/543, 604, 605

[56] References Cited

U.S. PATENT DOCUMENTS 5,609,997 3/1997 Okamoto et al. ..... 430/605

OTHER PUBLICATIONS

Research Disclosure, vol. 367, Nov. 1994, Item 36736.

*Primary Examiner*—Hoa Van Le
*Attorney, Agent, or Firm*—Carl O. Thomas

[57] ABSTRACT

When a color negative film is developed in 2 minutes or less at a temperature of less than 40° C. and contains in overlying blue and green recording layer units high bromide silver halide grains containing from 1 to 10 mole percent iodide, based on silver, and in an underlying red recording layer unit high bromide silver halide grains containing less than 0.05 mole percent iodide, based on silver, and at least $1\times10^{-6}$ mole per silver mole of a hexacoordination complex of a Group 8 metal and coordination ligands, at least four of the ligands being anionic and at least one of the ligands being more electronegative than halide ligands, loss of lower scale contrast in the red record attributable to the faster time of development is avoided.

9 Claims, No Drawings

REDUCED DEVELOPMENT TIME COLOR NEGATIVE PROCESS AND PROCESS COMPATIBLE COLOR NEGATIVE ELEMENTS

FIELD OF THE INVENTION

The invention relates to the photographic processing of color negative films that contain radiation-sensitive silver halide emulsions and form yellow, magenta and cyan dye images and to color negative films useful with the process.

DEFINITIONS

All references to silver halide grains and emulsions containing two or more halides name the halides in order of ascending concentrations.

The term "high bromide" is employed to indicate a bromide grain content of greater than 50 mole percent, based on silver.

The term "low iodide" is employed to indicate an iodide grain content of less than 0.05 mole percent, based on silver. Silver bromide emulsions are included within this definition.

All references to periods and groups within the periodic table of elements refers to the periodic table adopted by the American Chemical Society and published in the *Chemical and Engineering News*, Feb. 4, 1985, p. 26. In this form the prior numbering of the periods is retained, but the Roman numeral numbering of the groups and designations of A and B groups was replaced by a simple left to right 1 through 18 numbering of the groups.

The term "dopant" refers to a material other than a silver ion or halide ion contained within a silver halide grain.

In referring to blue, green and red recording layer units, the term "layer unit" indicates the hydrophilic colloid layer or layers that contain radiation-sensitive silver halide grains to capture exposing radiation and dye-forming couplers that react upon development of the grains. The grains and dye-forming coupler are usually in the same layer or layers, but can be in adjacent layers.

The term "equivalent circular diameter" or "ECD" is employed to indicate the diameter of a circle having the same projected area as a silver halide grain.

The term "aspect ratio" designates the ratio of grain ECD to grain thickness "t".

The term "tabular grain" indicates a grain having two parallel crystal faces which are clearly larger than any remaining crystal face and having an aspect ratio of at least 2.

The term "tabular grain emulsion" refers to an emulsion in which tabular grains account for greater than 50 percent of total grain projected area.

All coating coverages are in units of $g/m^2$, except as otherwise stated. Silver halide coating coverages are based on silver.

All percentages are percent by weight, based on total weight, except as otherwise stated.

The term "E" is used to indicate exposure in lux-seconds.

A relative speed difference of 1 unit is equal to 0.01 log E.

In referring to processing times, primes (') are used to indicate minutes and double primes (") are used to indicate seconds.

*Research Disclosure* is published by Kenneth Mason Publications, Ltd., Dudley House, 12 North St., Emsworth, Hampshire P010 7DQ, England.

BACKGROUND

In a simple construction, a conventional color negative film intended for in-camera exposure typically takes the following form:

| CNF-I |
|---|
| OC |
| BRLU |
| YFL |
| GRLU |
| IL |
| RRLU |
| AHL |
| TRANSPARENT FILM SUPPORT |

On the transparent film support are coated in the order shown, a series of processing solution penetrable hydrophilic colloid layers: antihalation layer AHL, a red recording layer unit RRLU containing a red sensitized silver iodobromide (AgIBr) emulsion and a cyan dye-forming coupler, an interlayer IL containing an oxidized developing agent scavenger, a green recording layer unit GRLU containing a green sensitized AgIBr emulsion and a magenta dye-forming coupler, a yellow filter layer YFL containing a Carey Lea silver or a processing solution decolorizable yellow filter dye and an oxidized developing agent scavenger, a blue recording layer unit BRLU containing blue sensitive (optionally blue sensitized) AgIBr emulsion and a yellow dye-forming coupler, and a transparent protective overcoat OC. In the simplest possible construction capable of producing a color negative image, all of the hydrophilic colloid layers, except BRLU, GRLU and RRLU can be omitted. In the overwhelming majority of practical applications all of the layers of CNF-I described above are employed and, most commonly, many additional addenda are incorporated for performance enhancement.

Camera speed films in general and color negative films in particular employ emulsions that contain silver iodobromide grains. Iodide in concentrations down to about 0.1 mole percent, based on silver, are well known to increase speed without increasing granularity. However, iodide ion released from the grains during development has the known disadvantage of slowing development rates. The reduction of development rates shows up particularly in the red recording layer unit of color negative films, since this recording layer unit receives developing agent only after the developer solution has already penetrated the overlying blue and green recording layer units.

The Kodak Flexicolor™ C-41 process is commonly employed for processing imagewise exposed color negative films. Since minor adjustments of the C-41 process are undertaken from time to time, the following detailed description is provided:

| | | |
|---|---|---|
| Develop | 3'15" Developer | 37.8° C. |
| Bleach | 4' Bleach | 37.8° C. |
| Wash | 3' | 35.5° C. |
| Fix | 4' Fixer | 37.8° C. |
| Wash | 3' | 35.5° C. |
| Rinse | 1' Rinse | 37.8° C. |

Developer

| | |
|---|---|
| Water | 800.0 mL |
| Potassium Carbonate, anhydrous | 34.30 g |
| Potassium bicarbonate | 2.32 g |
| Sodium sulfite, anhydrous | 0.38 g |

-continued

| | |
|---|---|
| Sodium metabisulfite | 2.96 g |
| Potassium Iodide | 1.20 mg |
| Sodium Bromide | 1.31 g |
| Diethylenetriaminepentaacetic acid pentasodium salt (40% soln) | 8.43 g |
| Hydroxylamine sulfate | 2.41 g |
| N-(4-amino-3-methylphenyl)-N-ethyl-2-aminoethanol | 4.52 g |
| Water to make | 1.0 L |
| pH @ 26.7° C. 10.00 +/− 0.05 | |
| Bleach | |
| Water | 500.0 mL |
| 1,3-Propylenediamine tetra-acetic acid | 37.4 g |
| 57% Ammonium hydroxide | 70.0 mL |
| Acetic acid | 80.0 mL |
| 2-Hydroxy-1,3-propylenediamine tetraacetic acid | 0.8 g |
| Ammonium Bromide | 25.0 g |
| Ferric nitrate nonahydrate | 44.85 g |
| Water to make | 1.0 L |
| pH 4.75 | |
| Fix | |
| Water | 500.0 mL |
| Ammonium Thiosulfate (58% solution) | 214.0 g |
| (Ethylenedinitrilo)tetraacetic acid disodium salt, dihydrate | 1.29 g |
| Sodium metabisulfite | 11.0 g |
| Sodium Hydroxide (50% solution) | 4.70 g |
| Water to make | 1.0 L |
| pH at 26.7° C. 6.5 +/− 0.15 | |
| Rinse | |
| Water | 900.0 mL |
| 0.5% Aqueous p-tertiary-octyl-(α-phenoxypolyethyl)alcohol | 3.0 mL |
| Water to make | 1.0 L |

Koboshi et al U.S. Pat. No. 4,937,178 discloses a process of producing a color negative image having a magenta dye density equal to at least 2 during a development time of not more than 3 minutes employing an imagewise exposed color negative film that produces a magenta dye density of less than 2 during development under conditions essentially similar to the Flexicolor™ C-41 process described above, except that to get higher magenta dye densities in a shorter development time "unconventionally active conditions" are employed. Development temperatures above 40° C. are indicated to be one approach for reducing development times, but, with various adjustments of the recording layer units, lower development temperatures are shown to be feasible. Koboshi et al requires that the silver halide grains contain at least 0.1 mole percent iodide, based on silver.

The use of dopants in silver halide grains to modify perfonnance characteristics is well recognized in the art. The use as dopants of coordination complexes of a Group 8 metal and one or more ligands more electronegative than halide ligands to increase photographic speed by acting as shallow electron traps (SET's) is disclosed in *Research Disclosure*, Vol. 367, November 1994, Item 36736. The SET dopants are identified to be useful for increasing photographic speed.

SUMMARY OF THE INVENTION

In one aspect this invention is directed to a photographic element capable of producing a color negative image comprised of a transparent film support and, coated on the support, a first recording layer unit, containing blue sensitive silver halide grains and yellow dye-forming coupler, located to receive exposing radiation prior to all other recording layer units, a second recording layer unit, containing green sensitized silver halide grains and magenta dye-forming coupler, located to receive exposing radiation from the first recording layer unit, and a third recording layer unit, containing red sensitized silver halide grains and cyan dye-forming coupler, located to receive exposing radiation from the second recording layer unit, wherein, the first and second recording layer units contain silver halide grains that are comprised of greater than 50 mole percent bromide and from 1 to 10 mole percent iodide, based on silver, and the third recording layer unit contains silver halide grains that are comprised of greater than 50 mole percent bromide and less than 0.05 mole percent iodide, based on silver, and contains at least $1\times10^{-6}$ mole per silver mole of a hexacoordination complex of a Group 8 metal and coordination ligands, at least four of the ligands being anionic and at least one of the ligands being more electronegative than halide ligands.

In another aspect the invention is directed to a process of producing a color negative image comprised of developing an imagewise exposed photographic element in 2 minutes or less at a temperature of less than 40° C. to create a silver image and yellow, magenta and cyan dye images, bleaching the silver image, and fixing to remove silver halide, the imagewise exposed photographic element being constructed as described in the preceding paragraph.

It has been observed that the objectionable loss of lower scale contrast in the red record that occurs in conventional color negative film when development times are reduced from the standard 3' 15" to 2 minutes or less can be offset without increasing development temperatures above 40° C. or undertaking any element modifications suggested by Koboshi et al to create "unconventionally active conditions". Whereas Koboshi et al requires AgIBr emulsions containing at least 0.5 mole percent iodide, based on silver, it has been discovered quite unexpectedly that reducing iodide ion in the silver halide grains of the third (red) recording layer unit results in red records with speed relationships matching those produced by AgIBr emulsions as well as lower scale contrasts that are superior to those obtained by AgIBr emulsions under the accelerated processing conditions contemplated.

The present invention offers the advantage of more rapid processing without resorting to objectionably high processing temperatures or modifying the composition of the color negative processing solutions that are now widely used commercially for processing color negative films. The reduction of iodide ion in silver halide grains in the red recording layer unit offers further advantages, since disposal of iodide ion that is a by-product of development and fixing is more environmentally burdensome than other halide ions.

DESCRIPTION OF PREFERRED EMBODIMENTS

The present invention is directed to a novel color negative film construction and to a process for producing a color negative image which employs the color negative film of the invention. The process is comprised of (1) developing in 2 minutes or less at a temperature of less than 40° C. an imagewise exposed color negative photographic element of the invention to create a silver image and yellow, magenta and cyan dye images, (2) bleaching the silver image, and (3) fixing to remove silver halide.

It has been discovered that the advantage of being able to reduce development times to 2 minutes or less while limiting development temperature to less than 40° C. while achieving a satisfactory red record in terms of speed, granularity and contrast can be realized by modifying at least one red recording layer unit of a conventional color negative film.

The color negative film constructions satisfying the requirements of the invention are comprised of a transparent film support and, coated on the support, a first recording layer unit, containing blue sensitive silver halide grains and yellow dye-forming coupler, located to receive exposing radiation prior to all other recording layer units, a second recording layer unit, containing green sensitized silver halide grains and magenta dye-forming coupler, located to receive exposing radiation from the first recording layer unit, and a third recording layer unit, containing red sensitized silver halide grains and cyan dye-forming coupler, located to receive exposing radiation from the second recording layer unit.

The blue sensitive (or sensitized) silver halide grains as well as the green sensitized silver halide grains are comprised of greater than 50 mole percent bromide, based on silver. In other words the grains are high bromide grains. The grains additionally contain from 1 to 10 mole percent iodide, based on silver. The remaining halide, if any, is chloride. The bromide concentration is preferably at least 70 mole percent, based on silver, and most preferably at least 90 mole percent, based on silver. Silver iodobromide grains, which are most widely employed in color negative films, are specifically contemplated and preferred.

The incorporation of iodide in the blue and green sensitized silver halide grains is undertaken to increase speed without increasing granularity. A minimum contemplated iodide level for these grains of 1 mole percent, based on silver, is sufficient to create a significant increase in imaging speed. Limiting iodide to 10 (preferably 7) mole percent, based on silver, allows the advantages of iodide incorporation to be realized fully while still allowing development in 2 minutes or less. Higher levels of iodide result in a slowing of development rates without offsetting advantages in imaging performance.

The incorporation of chloride ions in the blue and green sensitized silver halide grains is feasible, but is not preferred, since it adds to the complexity of grain preparation. It is well known that silver chloride develops at a much faster rate than silver bromide, which in turn develops at a faster rate than silver iodobromide. Thus, chloride ion inclusion can be undertaken to facilitate more rapid development, if desired. Delton U.S. Pat. Nos. 5,377,927 and 5,460,934, the disclosures of which are here incorporated by reference, disclose advantages to result from including chloride in concentrations of up to 20 mole percent, based on silver, in high bromide silver emulsions which can also contain up to 10 mole percent iodide, based on silver.

The third (red) recording layer unit contains red sensitized silver halide grains that contain greater than 50 mole percent bromide, based on silver. That is, these grains are also high bromide grains, but unlike the blue or green sensitized grains, they are also low iodide grains. That is, they contain less than 0.05 mole percent iodide, based on silver. Except for limiting the iodide content, the halide content of low iodide grains can satisfy the numerical ranges set out above for the blue sensitized grains and green sensitized grains. The red sensitized silver halide grains of the third recording layer unit are in one preferred form silver bromide grains.

In addition to limiting the iodide in the red sensitized grains of the third recording layer unit, at least $1\times10^{-6}$ mole per silver mole of a hexacoordination complex of a Group 8 metal is incorporated in these low iodide grains. To facilitate grain incorporation at least four of the ligands are anionic. Additionally, at least one of the ligands is more electronegative than halide ligands.

The Group 8 metal coordination complex can be introduced as a hexacoordination complex satisfying the formula:

$$[ML_6]^n \quad \text{(I)}$$

where

M is a divalent Group 8 cation (i.e, $Fe^{+2}$, $Ru^{+2}$ or $Os^{+2}$),

L represents six coordination complex ligands which can be independently selected, provided that at least four of the ligands are anionic ligands and at least one of the ligands is more electronegative than any halide ligand (i.e., more electron withdrawing than a fluoride ion, which is the most electronegative halide ion), and n is a negative integer having an absolute value of less than 5.

At least four of the ligands are required to be anionic to facilitate incorporation of the dopant into the crystal lattice structure of the tabular grains. The remaining two ligands can also be anionic or can take any convenient conventional neutral form, such as carbonyl, aquo or amine ligands.

Although only one of the ligands is required to be more electronegative than a halide ion, any higher number, up to and including all of the ligands can be more electronegative than a halide ion. One common way of assessing electron withdrawing characteristics is by reference to the spectrochemical series of ligands, derived from the absorption spectra of metal ion complexes in solution, referenced in *Inorganic Chemistry: Principles of Structure and Reactivity*, by James E. Huheey, 1972, Harper and Row, New York and in *Absorption Spectra and Chemical Bonding in Complexes* by C. K. Jorgensen, 1962, Pergamon Press, London. From these references the following order of ligands in the spectrochemical series is apparent:

$I^- < Br^- < S^{-2} < \underline{S}CN^- < Cl^- < NO_3^- < F^- < \underline{O}H$
$< ox^{-2} < H_2\underline{O} < NCS^- < CH_3C\underline{N}^- < \underline{N}H_3 <$ en $<$ dipy
$<$ phen $< \underline{N}O_2^- <$ phosph $<< C\underline{N}^- < \underline{C}O$. The abbreviations used are as follows: ox=oxalate, dipy=dipyridine, phen=o-phenathroline, and phosph=4-methyl-2,6,7-trioxa-1-phosphabicyclo[2.2.2]octane. The spectrochemical series places the ligands in sequence in their electron withdrawing properties, the first ($I^-$) ligand in the series being the least electron withdrawing and the last (CO) ligand being the most electron withdrawing. The underlining indicates the site of ligand bonding to the polyvalent metal ion. The efficiency of a ligand in providing the electron withdrawing characteristic needed for speed enhancement increases as the ligand atom bound to the metal changes from Cl to S to O to N to C. Thus, the ligands $\underline{C}N^-$ and $\underline{C}O$ are especially preferred. Other preferred ligands are thiocyanate ($\underline{N}CS^-$), selenocyanate ($\underline{N}CSe^-$), cyanate ($\underline{N}CO^-$), tellurocyanate ($\underline{N}CTe^-$) and azide ($N_3^-$).

When the metal M in the hexacoordination complex is $Fe^{+2}$, it is preferred that at least five of the ligands L be more electron withdrawing than a halide ion. When the metal M in the hexacoordination complex is $os^{+2}$, satisfactory speed enhancement is observed with only one ligand more electron withdrawing than a halide ion, but at least two such ligands are preferred. For $Ru^{+2}$ complexes it is preferred that at least three of the ligands be more electronegative than a halide ion.

The Group 8 coordination complexes when introduced can be associated with any convenient charge balancing counter ion, such as alkali, alkaline earth or ammonium ions. Subject to the requirements noted, the ligands L can be selected from conventional ligands, such as the various individual ligand forms disclosed in McDugle et al U.S. Pat.

Nos. 4,933,272, 4,981,781 and 5,037,732, Marchetti et al U.S. Pat. No. 4,937,180, Keevert et al U.S. Pat. No. 5,037,732 and Olm et al U.S. Pat. No. 5,360,712, the disclosures of which are here incorporated by reference.

The following are specific illustrations of Group 8 coordination complex dopants capable of enhancing speed when employed in combination with iridium dopants:

| | |
|---|---|
| SET-1 | $[Fe(CN)_6]^{-4}$ |
| SET-2 | $[Ru(CN)_6]^{-4}$ |
| SET-3 | $[Os(CN)_6]^{-4}$ |
| SET-4 | $[Fe(pyrazine)(CN)_5]^{-4}$ |
| SET-5 | $[RuC1(CN)_5]^{-4}$ |
| SET-6 | $[OsBr(CN)_5]^{-4}$ |
| SET-7 | $[FeCO(CN)_5]^{-3}$ |
| SET-8 | $[RuF_2(CN)_4]^{-4}$ |
| SET-9 | $[OsCl_2(CN)_4]^{-4}$ |
| SET-10 | $[Ru(CN)_5(OCN)]^{-4}$ |
| SET-11 | $[Ru(CN)_5(N_3)]^{-4}$ |
| SET-12 | $[Os(CN)_5(SCN)]^{-4}$ |
| SET-13 | $[Fe(CN)_3Cl_3]^{-3}$ |
| SET-14 | $[Ru(CO)_2(CN)_4]^{-1}$ |
| SET-15 | $[Os(CN)Cl_5]^{-4}$ |

The dopant can be placed in the grains at any convenient location. It is generally preferred to complete dopant addition prior to adding 90 percent of the total silver forming the grains. The presence of the dopant is compatible with other conventional dopants, such as iridium dopants commonly added to control reciprocity failure. When the Group 8 metal dopant is employed in combination with an iridium dopant, it is preferred to precipitate at least 10 (optimally 20) percent of total silver between Group 8 dopant and iridium dopant additions. When dopant additions partially overlap, antagonistic effects in the overlapping region can be offset by simply increasing the levels of the dopants.

The advantages contemplated by this invention can be realized with Group 8 dopant concentrations of up to $5\times10^{-4}$ mole per silver mole. A preferred Group 8 dopant concentration range is from $1\times10^{-5}$ to $1\times10^{-4}$ mole per silver mole.

It has been discovered unexpectedly that the combination of low iodide and Group 8 dopant in the third (red) recording layer unit allows red speeds to be realized that are comparable to those obtained with silver iodobromide emulsions having speed enhancing iodide concentrations in this layer unit while the lower scale contrasts obtained at development times of 2 minutes or less are higher than those obtained with comparable silver iodobromide emulsions having speed enhancing iodide concentrations.

Subject to the grain halide and dopant requirements set forth above, the blue, green and red sensitized silver halide grains can take any convenient conventional form. High bromide silver halide emulsions can be selected from among the variety of conventional emulsions disclosed in *Research Disclosure*, Vol. 389, September 1996, Item 38957, I. emulsion grains and their preparation. Chemical sensitization of the emulsions, which can take any conventional form, is illustrated in section IV. Chemical sensitization. Spectral sensitization and sensitizing dyes, which can take any conventional form, are illustrated by section V. Spectral sensitization and desensitization. The emulsion layers also typically include one or more antifoggants or stabilizers, which can take any conventional form, as illustrated by section VII. Antifoggants and stabilizers.

In a preferred form the high bromide emulsions present in the first, second and third recording layer units are tabular grain emulsions. Tabular grains account for greater than 50 percent of total grain projected area, preferably at least 70 percent of total grain projected area, and most preferably at least 90 percent of total grain projected area. The tabular grains have an average thickness of less than 0.3 $\mu$m, but, in the blue recording layer unit, average tabular grain thicknesses can usefully range up to 0.5 $\mu$m. It is preferred that the tabular grains have an average thickness of less than 0.2 $\mu$m. Ultrathin (t<0.07 $\mu$m) tabular grain emulsions are specifically contemplated and preferred, particularly for the minus blue (green and red) recording layer units. The tabular grains can range in ECD up to 10 $\mu$m, but are most typically in the range of from about 0.2 to 5 $\mu$m.

The following patents, the disclosures of which are here incorporated by reference, further illustrate conventional tabular grain emulsions useful in the practice of the invention, including inter alia grains, chemical sensitizers, spectral sensitizers and stabilizers and antifoggants. Where necessary to satisfy the lower iodide concentration levels of the third recording layer unit, iodide addition can be limited or omitted without otherwise modifying the procedures disclosed for emulsion preparation.

Daubendiek et al U.S. Pat. No. 4,414,310;
Abbott et al U.S. Pat. No. 4,425,426;
Wilgus et al U.S. Pat. No. 4,434,226;
Maskasky U.S. Pat. No. 4,435,501;
Kofron et al U.S. Pat. No. 4,439,520;
Solberg et al U.S. Pat. No. 4,433,048;
Evans et al U.S. Pat. No. 4,504,570;
Yamada et al U.S. Pat. No. 4,647,528;
Daubendick et al U.S. Pat. No. 4,672,027;
Daubendiek et al U.S. Pat. No. 4,693,964;
Sugimoto et al U.S. Pat. No. 4,665,012;
Daubendiek et al U.S. Pat. No. 4,672,027;
Yamada et al U.S. Pat. No. 4,679,745;
Daubendiek et al U.S. Pat. No. 4,693,964;
Maskasky U.S. Pat. No. 4,713,320;
Nottorf U.S. Pat. No. 4,722,886;
Sugimoto U.S. Pat. No. 4,755,456;
Goda U.S. Pat. No. 4,775,617;
Saitou et al U.S. Pat. No. 4,797,354;
Ellis U.S. Pat. No. 4,801,522;
Ikeda et al U.S. Pat. No. 4,806,461;
Ohashi et al U.S. Pat. No. 4,835,095;
Makino et al U.S. Pat. No. 4,835,322;
Daubendiek et al U.S. Pat. No. 4,914,014;
Aida et al U.S. Pat. No. 4,962,015;
Ikeda et al U.S. Pat. No. 4,985,350;
Piggin et al U.S. Pat. No. 5,061,609;
Piggin et al U.S. Pat. No. 5,061,616;
Tsaur et al U.S. Pat. No. 5,147,771;
Tsaur et al U.S. Pat. No. 5,147,772;
Tsaur et al U.S. Pat. No. 5,147,773;
Tsaur et al U.S. Pat. No. 5,171,659;
Tsaur et al U.S. Pat. No. 5,210,013;
Black et al U.S. Pat. No. 5,219,720;
Antoniades et al U.S. Pat. No. 5,250,403;
Kim et al U.S. Pat. No. 5,272,048;
Delton U.S. Pat. No. 5,310,644;
Chang et al U.S. Pat. No. 5,314,793;
Sutton et al U.S. Pat. No. 5,334,469;
Black et al U.S. Pat. No. 5,334,495;

Chaffee et al U.S. Pat. No. 5,358,840;
Delton U.S. Pat. No. 5,372,927;
Maskasky U.S. Pat. No. 5,411,851;
Maskasky U.S. Pat. No. 5,411,853;
Maskasky U.S. Pat. No. 5,418,125;
Delton U.S. Pat. No. 5,460,934;
Fenton et al U.S. Pat. No. 5,476,760;
Daubendiek et al U.S. Pat. No. 5,494,798;
Olm et al U.S. Pat. No. 5,503,970;
Daubendiek et al U.S. Pat. No. 5,503,971;
Daubendiek et al U.S. Pat. No. 5,573,902;
Daubendiek et al U.S. Pat. No. 5,576,168;
Olm et al U.S. Pat. No. 5,576,171;
Deaton et al U.S. Pat. No. 5,582,965;
Maskasky U.S. Pat. No. 5,604,085;
Reed et al U.S. Pat. No. 5,604,086;
Eshelman et al U.S. Pat. No. 5,612,176;
Levy et al U.S. Pat. No. 5,612,177;
Wilson et al U.S. Pat. No. 5,614,358;
Eshelman et al U.S. Pat. No. 5,614,359; and
Maskasky U.S. Pat. No. 5,620,840.

Except for the modified composition of the third (red) recording layer unit, a color negative film satisfying the requirements of the invention can take the form of CNF-I noted above. The structure of CNF-1 is set forth below with the labeling of the recording layer units modified to match the description above:

| CNF-I |
|---|
| OC |
| 1st(B)RLU |
| YFL |
| 2nd(G)RLU |
| IL |
| 3rd(R)RLU |
| AHL |
| TRANSPARENT FILM SUPPORT |

In addition to the silver halide grains yellow, magenta and cyan dyeforming couplers are present in the first (blue), second (green) and third (red) recording layer units, respectively.

In their simplest possible construction each of the first, second and third recording layer units contain a single high bromide emulsion. However, as elaborated on in *Research Disclosure*, Item 38957, I. Emulsion grains and their preparation, E. Blends, layers and performance categories, paragraph (7), when a fast emulsion layer is coated over a slow emulsion layer, an increase in imaging speed without an offsetting increase in granularity can be realized. Therefore, it is contemplated to double-coat or triple-coat by splitting the high bromide emulsions in first, second and third recording layer units into two or three separate emulsion layers differing in imaging speed.

A typical double-coated color negative film construction can take the following form:

| CNF-II |
|---|
| OC |
| 1st(B)RLU |
| Fast blue recording emulsion layer |
| Slow blue recording emulsion layer |
| YFL |
| 2nd(G)RLU |
| Fast green recording emulsion layer |
| Slow green recording emulsion layer |
| IL |
| 3rd(R)RLU |
| Fast red recording emulsion layer |
| Slow red recording emulsion layer |
| AHL |
| TRANSPARENT FILM SUPPORT |

It is also contemplated to space physically the fast and slow emulsion layers that record blue, green or red to minimize the number of slow emulsion layers that must be penetrated by exposing radiation to reach the fast green and/or fast red emulsion layers. These constructions increase the number of layer units. Two illustrative preferred constructions are illustrated by the following:

| CNF-III |
|---|
| OC |
| 1st(Fast B)RLU |
| IL |
| 2nd(Fast G)RLU |
| IL |
| 3rd(Fast R)RLU |
| IL |
| 4th(Slow B)RLU |
| YFL |
| 5th(Slow G)RLU |
| IL |
| 6th(Slow R)RLU |
| AHL |
| TRANSPARENT FILM SUPPORT |

and

| CNF-IV |
|---|
| OC |
| 1st(B)RLU |
| YFL |
| 2nd(Fast G)RLU |
| IL |
| 3rd(Fast R)RLU |
| IL |
| 4th(Mid G)RLU |
| IL |
| 5th(Mid R)RLU |
| IL |
| 6th(Slow G)RLU |
| IL |
| 7th(Slow R)RLU |
| AHU |
| TRANSPARENT FILM SUPPORT |

In comparing CNF-III and CNF-IV it should be noted that the former contains only fast and slow green and red recording layer units while the latter contains fast, mid and slow speed green and red recording layer units. It is appreciated that the CNF-III layer order arrangement could, if desired, be expanded to provide fast, mid and slow recording layer units in each of the blue, green and red. Similarly, the CNF-IV layer order arrangement could, if desired, be contracted to provide only fast and slow green and red recording layer units.

When three separate red recording layer units are present in a color negative film, the slowest red recording layer unit contains silver halide grains that either conform to the grain composition requirements for the third (red) recording layer unit, as described above, or conform to the grain composition requirements of the second (green) recording layer unit. The reason for this is that, when fast, mid and slow red recording layer units are all present in a single layer order arrangement, construction of the fast and mid red recording layer units according to the grain requirements noted above is sufficient to impart the advantages of the invention without relying on any further contribution by the slow red recording layer unit. Thus, the slowest red recording layer unit in a layer order arrangement containing three red recording layer units can be constructed to have high bromide low iodide grains containing a Group 8 dopant, as described above, or constructed to have high bromide grains containing from 1 to 10 mole percent iodide, based on silver. For the same reasons, when a single red recording layer unit contains fast, mid and slow speed emulsion layers the slowest emulsion layer can be constructed similarly as the slowest red recording layer unit.

The silver coating coverages in the various recording layer units are contemplated to fall within conventional ranges. Although the blue, green and red recording silver halide grains can each be present in a single recording layer unit or distributed among two or three recording layer units, it is appreciated that increasing the number of blue, green or red recording layer units from one to two or to three does not require any increase in the overall silver coating coverages. Preferably grains intended to record blue exposures are present in total silver coating coverages in the range of from 0.5 (most preferably 0.7) to 2.0 $g/m^2$. Preferably grains intended to record green exposures are present in total silver coating coverages in the range of from 1.0 to 2.8 $g/m^2$. Preferably grains intended to record red exposures are present in total silver coating coverages in the range from 1.0 (most preferably) 1.2 to 3.6 $g/m^2$.

When any one of the blue, green or red recording silver halide grains are divided between or among recording layer units, it is preferred that the recording layer unit located to first receive exposing radiation contain from about 10 to 40 percent of the total silver. With only fast and slow recording layer units, from 60 to 90 percent of the silver is located in the slow recording layer unit. With fast, mid and slow recording layer units, it is preferred that each of the mid and slow recording layer units contain at least 20 (most preferably at least 25) percent of the total silver.

Except for the features previously noted, the construction of the color negative films of the invention can take any convenient conventional form. Color negative films contain transparent film supports to facilitate exposure of a color print element through the color negative image in the film. The support can be either colorless or tinted. Details of film support construction are well understood in the art. Transparent film supports, including subbing layers to enhance adhesion are disclosed in *Research Disclosure*, Item 38957, cited above, XV. Supports.

All of the layers coated on the support in the layer arrangements described above are intended to be penetrated by processing solutions. Thus, these layers are all constructed employing hydrophilic colloid, such as gelatin or gelatin derivatives, as a vehicle. Hydrophilic colloid vehicles (including peptizers and binders) as well as vehicle extenders, such as latices, hydrophilic colloid modifiers (e.g., hardeners) as well as other related addenda are disclosed in *Research Disclosure*, Item 38957, II. Vehicles, vehicle extenders, vehicle-like addenda and vehicle related addenda.

The antihalation layers AHL are optional, but preferred to increase image sharpness. Instead of placing AHL between a red recording layer unit and the transparent film support as shown, it is also well known to place the antihalation layer on the back side of the support. As shown above, AHL in this instance is repositioned below the transparent film support. The antihalation layer contains a dye that can be decolorized in processing. In other words, AHL absorbs light during imagewise exposure, but is rendered colorless prior to printing. If AHL leaves any residual stain, this can be compensated for by adjusting the light source used in printing. Useful antihalation dyes and their decolorization are illustrated by *Research Disclosure*, Item 38957, XIII. Absorbing and scattering materials, B. Absorbing materials and C. Discharge.

The interlayers IL as well as YFL separate recording layer units that are responsive to different regions of the spectrum. An oxidized developing agent scavenger (also sometimes referred to as an antistain agent) is preferably positioned in IL and YFL to reduce or eliminate color contamination resulting from the migration of oxidized developing agent between recording layer units. Oxidized developing agent scavengers are disclosed in *Research Disclosure*, Item 38957, X. Dye image formers and modifiers, D. Hue modifiers/stabilization, paragraph (2).

The yellow filter layer YFL additionally contains either Carey Lea silver, which is removed during bleaching and fixing, or a yellow dye that can be decolorized during processing. Suitable yellow filter dyes are included among the dyes disclosed in *Research Disclosure*, Item 38957, B. Absorbing materials, cited above.

The blue recording layer unit contains at least one yellow dye-forming coupler. Each green recording layer unit contains at least one magenta dye-forming coupler, and each red recording layer unit contains at least one cyan dye-forming coupler. The dye-forming couplers can be chosen from among any convenient combination of conventional dye image-forming couplers. Preferred cyan dye forming couplers for inclusion in the third (red) recording layer unit and particularly in the fast red emulsion layer are 2-(alkoxyphenylcarbamoyl)-1-naphthol couplers, such as those disclosed Vanden Eynde et al U.S. Pat. No. 3,488,193 and Kobayashi et al U.S. Pat. No. 4,957,853, the disclosures of which are here incorporated by reference. Conventional dye image-forming couplers are illustrated by *Research Disclosure*, Item 38957, cited above, X. Dye image formers and modifiers, B. Image-dye-fonning couplers. Dye-forming couplers that combine with oxidized developer to produce cyan colored dyes are listed in paragraph (4). Dye-forming couplers that combine with oxidized developer to produce magenta colored dyes are listed in paragraph (5). Dye-forming couplers that combine with oxidized developer to produce yellow colored dyes are listed in paragraph (6). Compounds that are used with dye-forming couplers to modify the dye image, which are themselves often (but not always) dye-forming couplers, are disclosed in *Research Disclosure*, Item 13857, X. Dye image formers and modifiers, C. Image dye modifiers and D. Hue modifiers/stabilization. Techniques for dispersing dye-forming couplers and image dye modifiers are disclosed in E. Dispersing dyes and dye precursors.

Since dye-forming couplers often produce image dyes that exhibit significant absorption outside of the desired region of the spectrum, it is common practice to incorporate masking dyes, including colored masking couplers, in color negative films. The masking couplers are incorporated with the dye image-forming couplers in the recording layer units. Preformed masking dyes that remain invariant in hue during processing can be incorporated in the recording layer units or in any other layer that does not interfere with imagewise exposure-e.g., in the antihalation layer. Masking dyes, including colored masking couplers, are disclosed in *Research Disclosure*, Item 38957, XII. Features applicable only to color negative, particularly paragraphs (1) and (2).

The surface overcoats OC are hydrophilic colloid layers that are provided for physical protection of the color negative elements during handling and processing. Each OC also provides a convenient location for incorporation of addenda that are most effective at or near the surface of the color negative element. In some instances the surface overcoat is divided into a surface layer and an interlayer, the latter functioning as a spacer between the addenda in the surface layer and the adjacent recording layer unit. In another common variant form, addenda are distributed between the surface layer and the interlayer, with the latter containing addenda that are compatible with the adjacent recording layer unit. Most typically OC contains addenda, such as coating aids, plasticizers and lubricants, antistats and matting agents, such as illustrated by *Research Disclosure*, Item 38957, IX. Coating physical property modifying addenda. It is also common practice to coat an overcoat layer on the back side of the support to locate some or all of the physical property modifying addenda also adjacent to the back surface of the film. The overcoat layers overlying the emulsion layers additionally preferably contain an ultraviolet absorber, such as illustrated by *Research Disclosure*, Item 38957, VI. UV dyes/optical brighteners/luminescent dyes, paragraph (1).

The color negative films of the invention can be imagewise exposed in any convenient conventional manner. The color negative films are specifically contemplated for use as camera speed films having ISO ratings of from 10 to 2000, most commonly from ISO 100 to ISO 1000. They can be color balanced for exposure under tungsten illumination, for daylight exposure or for flash exposure.

Following imagewise exposure photographic processing can be undertaken to produce internal yellow, magenta and cyan negative dye images useful for printing a viewable color positive image. In a preferred form it is contemplated to modify the Kodak Flexicolor™ C-41 process described above by reducing development times to 2 minutes or less. Development times of 1' 45" are demonstrated in the Examples below, and development times of 30" or less are considered feasible. Apart from the required modifications of the color negative films described above, the reduction in development time from 3' 15" to 2' or less can be accomplished while retaining good image qualities by increasing the temperature of the development step. Development temperatures of up to about 80° C. are contemplated. It is also possible to modify the developer composition to increase its activity, thereby contributing to shorter processing times. Further, it is possible to adjust dye-forming coupler concentrations and activity levels in the color negative films to allow for more rapid development. Development temperatures of from 40 to 60° C. are preferred for accelerated development, most preferably in combination with one or more of the optional color negative film adjustments of the type described above.

Although the color negative films of the invention are specifically contemplated for use in a shortened development step form of the Kodak Flexicolor™ C-41, demonstrated in the Examples below, it is appreciated that useful color negative images can be obtained in a wide variety of processing compositions and under a variety of processing conditions. For example, color negative elements satisfying the requirements of the invention can be processed in 2' or less in similarly modified commercial color negative processes, such as the Kodacolor C-22 ™ process, the Agfacolor processes described in *British Journal of Photography Annual*, 1977, pp. 201–205, and 1988, pp. 196–198, Kodak motion picture processes ECN-2, ECN-2a and ECN-2b.

In color negative processing the first and only absolutely essential step to creating the internal yellow, magenta and cyan dye image structure sought is the step of color development. Color developing solutions typically contain a primary aromatic amino color developing agent. These color developing agents are well known and widely used in a variety of color photographic processes. They include amninophenols and p-phenylenediamines.

Examples of aminophenol developing agents include o-aminophenol, p-aminophenol, 5-amino-2-hydroxytoluene, 2-amino-3-hydroxytoluene, and 2-hydroxy-3-amino-1,4-dimethylbenzene.

Particularly useful primary aromatic amino color developing agents are the p-phenylenediamines and especially the N,N-dialkyl-p-phenylenediamines in which the alkyl groups or the aromatic nucleus can be substituted or unsubstituted. Examples of useful p-phenylenediamine color developing agents include: N,N-diethyl-p-phenylenediamonohydrochloride, 4-N,N-diethyl-2-methylphenylenediamine monohydrochloride, 4-(N-ethyl)-N-2-methanesulfonylaminoethyl)-2-methylphenylenediamine sesquisulfate monohydrate and 4-(N-ethyl-N-2-hydroxyethyl)-2-methylphenylenediamine sulfate.

In addition to the primary aromatic amino color developing agent, color developing solutions typically contain a variety of other agents, such as alkali hydroxides to control pH, halides (e.g., bromides and/or iodides), benzyl alcohol, antioxidants, antifoggants, solubilizing agents, and brightening agents. Useful developer addenda are disclosed in *Research Disclosure*, Item 38957, XIX. Development, except that only color developing agents are useful.

Color developing compositions are employed in the form of aqueous alkaline working solutions having a pH of above 7 and typically in the range of from 9 to 13. To provide the necessary pH, the solutions contain one or more of the well known and widely used buffering agents, such as the alkali metal carbonates or phosphates. Potassium carbonate is especially useful as a buffering agent for color developing compositions.

Once the color negative dye images are obtained by development it is conventional practice to reconvert developed silver to silver halide by bleaching and then to remove the silver halide by fixing. Removal of the silver image removes the neutral silver density that is superimposed on the image dye density thereby constituting a hindrance to printing. Removal of the silver halide by fixing is undertaken to allow the developed color negative element to be handled in room light without printout (that is, without reduction of the remaining silver halide to silver) which objectionably increases minimum densities of each of the dye images. Bleaching and fixing can both be accomplished in a single bleach-fix (a.k.a., blix) solution, if desired. It is common practice to use a stop bath, such as dilute acetic acid, to lower pH and terminate color development. Usually washing or rinsing steps are conducted between development and bleaching and, where separate bleach and fix solutions are employed, between the bleaching and fixing step. A washing step is also commonly used after fixing.

*Research Disclosure*, Item 38957, XX. Desilvering, washing, rinsing and stabilizing, discloses bleaching solutions, fixing solutions, bleach-fixing solutions, and washing, rinsing and stabilizing solutions that can be used in the photographic processing of the invention.

EXAMPLES

The invention can be better appreciated by reference to the following specific embodiments.

Example 1

Preparation of Red Sensitized AgBr Emulsions

Emulsion E-1

This describes the preparation of a silver bromide tabular grain exhibiting a mean grain ECD of 1.95 μm and a mean grain thickness of 0.103 μm. The tabular grains accounted for greater than 90 percent of total grain projected area.

A vessel equipped with a stirrer was charged with 6 liters of water containing 3.4 g of oxidized bone gelatin, 6.7 g of sodium bromide, 0.5 g of surfactant PLURONIC 31 R1™, a surfactant satisfying the formula:

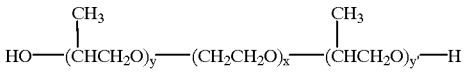

where x=7, y=25 and y'=25, and sufficient nitric acid to achieve a pH of 1.85 at 45° C. While keeping the temperature at 45° C., 68 mL of a 0.25 molar silver nitrate solution and 68 mL of a 0.25 molar sodium bromide solution were simultaneously added over a period of 1 minute at a constant rate. The mixture was held and stirred for 1 minute during which 92 mL of an aqueous sodium bromide solution (containing 8.8 g of sodium bromide) were added. Thereafter, the temperature of the mixture was raised to 60° C. over a period of 9 minutes. Then 100 mL of an aqueous solution of ammonium sulfate (containing 10 g of ammonium sulfate) were added, and the pH of the mixture was adjusted to 9.5 with aqueous sodium hydroxide. The mixture thus prepared was stirred for 9 minutes. Then 523 g of an aqueous gelatin solution (containing 100 g of oxidized bone gelatin) were added, followed by a pH adjustment of 5.9 using nitric acid. The pBr was then controlled at 1.82 at 60° C. while a 0.25 molar silver nitrate solution and a 0.25 molar sodium bromide solution were added by double jet addition using a constant flow rate over a period of 15 minutes, consuming 0.045 mole of silver. Thereafter a 1.6 molar silver nitrate solution and a 1.75 molar sodium bromide solution were added over a period of 24.5 minutes using an accelerated flow rate such that the final molar flow rate was 5 times that at the beginning, adding a total of 0.47 mole. Thereafter a 2.4 molar silver nitrate and a 2.5 molar sodium bromide solution were added over a period of 57.4 minutes by an accelerated flow rate such that final molar flow rate was 4.3 times that at the beginning, adding a total of 3.65 moles. Silver nitrate in the amount of 0.9 mole of was then added over a period of 8.3 minutes during which time the pBr was adjusted from 1.82 to 2.66 at 60° C. During the next 1 minute an aqueous solution containing a total of 0.16 g ($4.8\times10^{-5}$ mole per mole of total silver) of potassium hexacyanortithenate was added to the mixture. Thereafter a 2.4 molar silver nitrate and a 2.5 molar sodium bromide solution were added over a period of 16.7 minutes, adding a total of 2.12 moles of silver at a controlled pBr of 2.66. A further 0.83 mole of 2.4 molar silver nitrate was added over a period of 6 minutes during which time the pBr was adjusted from 2.66 to 2.50 using a 2.5 molar solution of sodium bromide. The emulsion was then cooled to 40° C. and washed. A total of 8.04 moles of silver had been added.

Emulsion E-2

This describes the preparation of a silver bromide tabular grain exhibiting a mean ECD of 1.45 μm and a mean grain thickness of 0.105 μm. The tabular grains accounted for greater than 90 percent of total grain projected area.

A vessel equipped with a stirrer was charged with 6 liters of water containing 3.4 g of oxidized bone gelatin, 6.7 g of sodium bromide, 0.5 g of surfactant PLURONIC 31 R1™ and sufficient nitric acid to achieve a pH of 1.85 at 45° C. While keeping the temperature at 45° C., 68 mL of a 0.25 molar silver nitrate solution, and 68 mL of a 0.25 molar sodium bromide solution were simultaneously added over a period of 1 minute at a constant rate. The mixture was held and stirred for 1 minute during which 92 mL of an aqueous sodium bromide solution (containing 8.8 g of sodium bromide) were added. Thereafter, the temperature of the mixture was raised to 58° C. over a period of 4 minutes. Then 100 mL of an aqueous solution of ammonium sulfate (containing 10 g of ammonium sulfate) were added, and the pH of the mixture was adjusted to 9.5 with aqueous sodium hydroxide. The mixture thus prepared was stirred for 9 minutes. Then 523 g of an aqueous gelatin solution (containing 100 g of oxidized bone gelatin) were added, followed by a pH adjustment to 5.9, using nitric acid. Then the pBr was controlled at 1.84 at 58° C. while a 0.25 molar silver nitrate solution and a 0.25 molar sodium bromide solution were added by double jet addition using a constant flow rate over a period of 15 minutes, consuming 0.045 mole of silver. Thereafter a 1.6 molar silver nitrate solution and a 1.75 molar sodium bromide solution were added over a period of 24.5 minutes using an accelerated flow rate such that the final molar flow rate was 5 times that at the beginning, adding a total of 0.47 mole. Thereafter a 2.4 molar silver nitrate and a 2.5 molar sodium bromide solution were added over a period of 57.4 minutes by an accelerated flow rate such that final molar flow rate was 4.3 times that at the beginning, adding a total of 3.65 moles. Silver nitrate in the amount of 0.9 mole was then added over a period of 8.3 minutes during which time the pBr was adjusted from 1.84 to 2.68 at 58° C. During the next 1 minute an aqueous solution containing a total of 0.16 g ($4.8\times10^{-5}$ mole per mole of total silver) of potassium hexacyanoruthenate was added to the mixture. Thereafter 2.4 molar silver nitrate and 2.5 molar sodium bromide solutions were added over a period of 16.7 minutes, adding a total of 2.12 moles of silver at a controlled pBr of 2.68. A further 0.83 mole of 2.4 molar silver nitrate was added over a period of 6 minutes during which time the pBr was adjusted from 2.68 to 2.53 using a 2.5 molar solution of sodium bromide. The emulsion was then cooled to 40° C. and washed. A total of 8.04 moles of silver had been added.

Sensitizations

The following sensitizing dyes were used for sensitizations:

Dye 1

Anhydro-5,5'-dichloro-9-ethyl-3, 3'-bis(3-sulfopropyl) thiacarbocyanine hydroxide, triethyl ammonium salt Dye 2

Anhydro-9-ethyl-5,5'-dimethyl-3, 3'-bis(3-sulfopropyl) thiacarbocyanine hydroxide, triethyl ammonium salt Emulsions E-1 and E-2 were sensitized as follows:

The emulsion was melted at 40° C. and bone gelatin and water were added to bring the total gelatin level to 65 g/Ag mole. Next an aqueous solution containing 120 mg/Ag mole of sodium thiocyanate was added to the emulsion. Dye 1 and Dye 2 were added with stirring to the emulsion, in a molar ratio of 9:1 to provide a 90% monolayer coverage of the grain surfaces, and the emulsion was held at 40° C. for 30 minutes. Gold and sulfur containing chemical sensitizers were then added at levels chosen to provide substantially optimum sensitizations. Benzothiazolium tetrafluoroborate in the amount of 20 mg/Ag mole was then added, and the emulsion was digested at 60° C. for 20 minutes. The emulsion was cooled to 40° C. and 4-hydroxy-6-methyl-1, 3,3a, 7-tetraazaindene (Na+salt) was added.

Example 2

Comparison of Color Negative Films at Various Processing Conditions

The multilayer film structures utilized for the example are shown schematically for color negative Films A, B, C, and D in Tables I, II, III and IV respectively. Component laydowns in g/m$^2$ are shown in parenthesis. Gelatin was used as a binder in the various film layers.

TABLE I

| Color Negative Film A (CNF-A) | |
|---|---|
| Overcoat Layer | Matte Beads<br>UV Absorber UV-7 (0.108) & S-9 (0.108)<br>UV Absorber UV-8 (0.108) & S-9 (0.108)<br>Silver Bromide Lippmann Emulsion (0.215)<br>Gelatin (0.70)<br>Bis(vinylsulfonyl)methane Hardener (at 1.8% by weight of total gelatin) |
| Fast Yellow Layer | Y-15 (0.108) & S-2 (0.108)<br>Y-14 (0.183) & S-2 (0.092)<br>D-3 (0.097) & S-2 (0.097)<br>C-22 (0.005) (BARC) & S-3 (0.005)<br>Blue Sensitized Silver Iodobromide Emulsion (0.592 Ag)<br>4.1 mole % Iodide T-Grain ™<br>(ECD 2.6 μm, t 0.134 μm)<br>Gelatin (1.53) |
| Slow Yellow Layer | Y-15 (0.538) & S-2 (0.538)<br>Y-14 (0.484) & S-2 (0.242)<br>D-3 (0.086) & S-2 (0.086)<br>C-22 (0.011) (BARC) & S-3 (0.011)<br>Blue Sensitized Silver Iodobromide Emulsion (0.269 Ag)<br>4.1 mole % Iodide T-Grain ™<br>(ECD 1.3 μm, t 0.13 μm)<br>Blue Sensitized Silver Iodobromide Emulsion (0.161 Ag)<br>1.5 mole % Iodide T-Grain ™<br>(ECD 1.0 μm × 0.13 μm)<br>Blue Sensitized Silver Iodobromide Emulsion (0.108 Ag)<br>1.3 mole % Iodide T-Grain ™<br>(ECD 0.54 μm, t 0.084 μm)<br>Gelatin (1.95) |
| Interlayer | Dye-4 Filter Dye (0.108)<br>ST-4 (0.086) & S-2 (0.139)<br>Gelatin (0.646) |
| Fast Magenta Layer | M-5 (0.032) Magenta Dye Forming Coupler & S-1 (0.026) & ST-5 (0.006) Addendum<br>MC-2 (0.054) Masking Coupler & S-1 (0.108)<br>D-4 (0.011) & S-2 (0.011)<br>Green Sensitized Silver Iodobromide Emulsion (0.484 Ag)<br>4.1 mole % Iodide T-Grain ™<br>(ECD 1.25 μm, t 0.12 μm)<br>Gelatin (0.742) |
| Mid Magenta Layer | M-5 (0.161) & S-1 (0.129) & ST-5 Addendum (0.032)<br>MC-2 (0.065) Masking Coupler & S-1 (0.129)<br>D-4 (0.043) & S-1 (0.043)<br>Green Sensitized Silver Iodobromide Emulsion (0.699 Ag)<br>4.1 mole % Iodide T-Grain ™<br>(ECD 1.05 μm, t 0.115 μm)<br>Gelatin (0.850) |
| Slow Magenta Layer | M-5 (0.377) & S-1 (0.301) & ST-5 Addendum (0.076)<br>MC-2 (0.065) Masking Coupler & S-1 (0.129)<br>Green Sensitized Silver Iodobromide Emulsion (0.161 Ag)<br>2.6 mole % Iodide T-Grain ™<br>(ECD 0.75 μm, t 0.115 μm)<br>Green Sensitized Silver Iodobromide Emulsion (0.054 Ag)<br>1.3 mole % Iodide T-Grain ™<br>(ECD 0.54 μm, t 0.084 μm)<br>Gelatin (0.990) |
| Interlayer | ST-4 Oxidized Developer Scavenger (0.075) & S-2 (0.122)<br>Gelatin (0.430) |
| Fast Cyan Layer | C-2 (0.129) Cyan Dye-Forming Coupler & S-2 (0.129)<br>C-2 (0.030) & B-1 (0.030) DIAR & S-2 (0.060)<br>C-2 (0.048) & D-5 (0.048) DIR & S-1 (0.097)<br>MC-1 (0.032) Masking Coupler<br>Red Sensitized Silver Iodobromide Emulsion (0.430 Ag)<br>4.1 mole % Iodide T-Grain ™<br>(ECD 1.25 μm, t 0.12 μm)<br>Gelatin (0.807) |
| Mid Cyan Layer | C-2 (0.355) & S-2 (0.355)<br>C-2 (0.019) & B-1 (0.019) & S-2 (0.039)<br>C-22 (0.008) & S-3 (0.008)<br>MC-1 (0.032)<br>Red Sensitized Silver Iodobromide Emulsion (0.721 Ag)<br>4.1 mole % Iodide T-Grain ™<br>(ECD 1.05, t 0.115 μm)<br>Gelatin (1.12) |
| Slow Cyan Layer | C-2 (0.538) & S-2 (0.0538)<br>C-2 (0.008) & B-1 (0.008) & S-2 (0.016)<br>C-22 (0.056) & S-3 (0.056)<br>Y-15 (0.065) & S-2 (0.065)<br>Red Sensitized Silver Iodobromide Emulsion (0.248 Ag)<br>4.1 mole % Iodide T-Grain ™<br>(ECD 0.73, t 0.12 μm)<br>Red Sensitized Silver Iodobromide Emulsion (0.237 Ag)<br>1.3 mole % Iodide T-Grain ™<br>(ECD 0.54, t 0.084 μm)<br>Gelatin (1.36) |
| Antihalation Layer | Gray Silver (0.151 Ag)<br>Dye-7 (0.011)<br>Dye-5 (0.047)<br>Dye-6 (0.092)<br>ST-4 (0.108) & S-2 (0.172)<br>UV-7 (0.075) & S-9 (0.075)<br>UV-8 (0.075) & S-9 (0.075)<br>Gelatin (1.61)<br>Cellulose Triacetate Support |

TABLE II

| Color Negative Film B (CNF-B) | |
|---|---|
| Overcoat Layer | Same as CNF-A |
| Fast Yellow Layer | Same as CNF-A |
| Slow Yellow Layer | Same as CNF-A |
| Interlayer | Same as CNF-A |
| Fast Magenta Layer | Same as CNF-A |
| Mid Magenta Layer | Same as CNF-A |
| Slow Magenta Layer | Same as CNF-A |
| Interlayer | Same as CNF-A |
| Fast Cyan Layer | C-2 (0.129) Cyan Dye Forming Coupler & S-2 (0.129) |

TABLE II-continued

| Color Negative Film B (CNF-B) | |
|---|---|
| | C-2 (0.030) & B-1 (0.030) DIAR & S-2 (0.060) |
| | C-2 (0.048) & D-5 (0.048) DIR & S-1 (0.097) |
| | MC-1 (0.032) Masking Coupler |
| | Red Sensitized Silver Bromide Emulsion E-1 (0.430 Ag) |
| | Gelatin (0.807) |
| Mid Cyan Layer | C-2 (0.355) & S-2 (0.355) |
| | C-2 (0.019) & B-1 (0.019) & S-2 (0.039) |
| | C-2 (0.008) & S-3 (0.008) |
| | MC-1 (0.032) |
| | Red Sensitized Silver Bromide Emulsion E-2 (0.721 Ag) |
| | Gelatin (1.12) |
| Slow Cyan Layer | Same as CNF-A |
| Antihalation Layer | Same as CNF-A |
| | Cellulose Triacetate Support |

TABLE III

| Color Negative Film C (CNF-C) | |
|---|---|
| Overcoat Layer | Same as CNF-A |
| Fast Yellow Layer | Y-15 (0.753) & S-2 (0.753) |
| | Y-14 (0.183) & S-2 (0.092) |
| | D-3 (0.097) & S-2 (0.097) |
| | C-22 (0.005) (BARC) & S-3 (0.005) |
| | Blue Sensitized Silver Iodobromide Emulsion (0.592 Ag) |
| | 4.1 mole % Iodide T-Grain ™ (2.6 × 0.134 μm) |
| | Gelatin (1.53) |
| Slow Yellow Layer | Y-15 (0.646) & S-2 (0.646) |
| | Y-14 (0.484) & S-2 (0.242) |
| | D-3 (0.086) & S-2 (0.086) |
| | C-22 (0.011) (BARC) & S-3 (0.011) |
| | Blue Sensitized Silver Iodobromide Emulsion (0.592 Ag) |
| | 4.1 mole % Iodide T-Grain ™ (ECD 1.3 μm, t 0.13 μm) |
| | Blue Sensitized Silver Iodobromide Emulsion (0.161 Ag) |
| | 1.5 mole % Iodide T-Grain ™ (ECD 1.0 μm, t 0.13 μm) |
| | Blue Sensitized Silver Iodobromide Emulsion (0.538 Ag) |
| | 1.3 mole % Iodide T-Grain ™ (ECD 0.54 μm, t 0.084 μm) |
| | Gelatin (1.95) |
| Interlayer | Same as CNF-A |
| Fast Magenta Layer | M-5 (0.161) Magenta Dye Forming Coupler & S-1 (0.129) & ST-5 (0.032) Addendum |
| | MC-2 (0.054) Masking Coupler & S-1 (0.108) |
| | D-4 (0.011) & S-2 (0.011) |
| | Green Sensitized Silver Iodobromide Emulsion (0.484 Ag) |
| | 4.1 mole % Iodide T-Grain ™ (ECD 1.25 μm, t 0.12 μm) |
| | Gelatin (0.742) |
| Mid Magenta Layer | M-5 (0.538) & S-1 (0.430) & ST-5 Addendum (0.108) |
| | MC-2 (0.065) Masking Coupler & S-1 (0.129) |
| | D-4 (0.043) & S-1 (0.043) |
| | Green Sensitized Silver Iodobromide Emulsion (0.968 Ag) |
| | 4.1 mole % Iodide T-Grain ™ (ECD 1.05 μm, t 0.115 μm) |
| | Gelatin (0.850) |
| Slow Magenta Layer | M-5 (0.215) & S-1 (0.172) & ST-5 Addendum (0.043) |
| | MC-2 (0.065) Masking Coupler & S-1 (0.129) |
| | Green Sensitized Silver Iodobromide Emulsion (0.861 Ag) |
| | 2.6 mole % Iodide T-Grain ™ (ECD 0.75 μm, t 0.115 μm) |

TABLE III-continued

| Color Negative Film C (CNF-C) | |
|---|---|
| | Green Sensitized Silver Iodobromide Emulsion (0.054 Ag) |
| | 1.3 mole % Iodide T-Grain ™ (ECD 0.54 μm, t 0.084 μm) |
| | Gelatin (0.990) |
| Interlayer | Same as CNF-A |
| Fast Cyan Layer | C-12 (0.430) Cyan Dye-Forming Coupler & S-2 (0.430) |
| | C-2 (0.030) & B-1 (0.030) DIAR & S-2 (0.060) |
| | C-2 (0.048) & D-5 (0.048) DIR & S-1 (0.097) |
| | MC-1 (0.032) Masking Coupler |
| | Red Sensitized Silver Iodobromide Emulsion (0.430 Ag) |
| | 4.1 mole % Iodide T-Grain ™ (ECD 1.25 μm, t 0.12 μm) |
| | Gelatin (0.807) |
| Mid Cyan Layer | C-2 (1.022) & S-2 (1.022) |
| | C-2 (0.019) & B-1 (0.019) & S-2 (0.039) |
| | C-22 (0.008) & S-3 (0.008) |
| | MC-1 (0.032) |
| | Red Sensitized Silver Iodobromide Emulsion (0.646 Ag) |
| | 4.1 mole % Iodide T-Grain ™ (ECD 1.05 μm, t 0.115 μm) |
| | Gelatin (1.12) |
| Slow Cyan Layer | C-2 (0.968) & S-2 (0.968) |
| | C-2 (0.008) & B-1 (0.008) & S-2 (0.016) |
| | C-22 (0.056) & S-3 (0.056) |
| | Y-15 (0.065) & S-2 (0.065) |
| | Red Sensitized Silver Iodobromide Emulsion (1.614 Ag) |
| | 4.1 mole % Iodide T-Grain ™ (ECD 0.73 μm, t 0.12 μm) |
| | Red Sensitized Silver Iodobromide Emulsion (0.807 Ag) |
| | 1.3 mole % Iodide T-Grain ™ (ECD 0.54 μm, t 0.084 μm) |
| | Gelatin (1.36) |
| Antihalation Layer | Same as CNF-A |
| | Cellulose Triacetate Support |

TABLE IV

| Color Negative Film D (CNF-D) | |
|---|---|
| Overcoat Layer | Same as CNF-C |
| Fast Yellow Layer | Same as CNF-C |
| Slow Yellow Layer | Same as CNF-C |
| Interlayer | Same as CNF-C |
| Fast Magenta Layer | Same as CNF-C |
| Mid Magenta Layer | Same as CNF-C |
| Slow Magenta Layer | Same as CNF-C |
| Interlayer | Same as CNF-C |
| Fast Cyan Layer | C-12 (0.430) Cyan Dye Forming Coupler & S-2 (0.430) |
| | C-2 (0.030) & B-1 (0.030) DIAR & S-2 (0.060) |
| | C-2 (0.048) & D-5 (0.048) DIR & S-1 (0.097) |
| | MC-1 (0.032) Masking Coupler |
| | Red Sensitized Silver Bromide Emulsion E-1 (0.430 Ag) |
| | Gelatin (0.807) |
| Mid Cyan Layer | C-2 (1.022) & S-2 (1.022) |
| | C-2 (0.019) & B-1 (0.019) & S-2 (0.039) |
| | C-22 (0.008) & S-3 (0.008) |
| | MC-1 (0.032) |
| | Red Sensitized Silver Bromide Emulsion E-2 (0.646 Ag) |
| | Gelatin (1.12) |
| Slow Cyan Layer | Same as CNF-C |
| Antihalation Layer | Same as CNF-C |
| | Cellulose Triacetate Support |

Films CNF-A and CNF-B were exposed through a step tablet on an Eastman 1B™ sensitometer and processed through the KODAK FLEXICOLOR™ C-41 process as described below. The step tablet was divided into 21 density steps, with step 1 having a density of 4 and step 21 having a density of zero.

TABLE V

Processing Solutions and Conditions

| Solution | Agitation | Processing Time | Temperature |
|---|---|---|---|
| Developer | Nitrogen Burst | 3'15" | 37.8 C. |
| Fresh Bleach II | Continuous Air | 4' | 37.8 C. |
| Wash | Continuous Air | 3' | 35.5 C. |
| Fix | Continuous Air | 4' | 37.8 C. |
| Wash | Continuous Air | 3' | 35.5 C. |
| PHOTO-FLO ™ | None | 1' | 37.8 C. |

Films CNF-C and CNF-D were similarly exposed through a step tablet and processed through the KODAK FLEXICOLOR™ C-41 process using a development time of 1'45".

The Status M densities of the processed films were then measured via a densitometer. By plotting density vs Log exposure, characteristic (H&D) curves were obtained from which performance characteristics were read. Red inertial speeds were measured at a density of Dmin+0.15. The lower scale red gammas were measured via a least squares fit to the sensitometric curves over the range from point A=Dmin+0.05 to point B=point A+0.80 log E. The red speeds and gammas for Films CNF-A, CNF-B, CNF-C and CNF-D in their respective processes are compared in Table VI below:

TABLE VI

Sensitometric Comparisons

| Film | Development Time | Red Inertial Speed | Lower Scale Red Gamma |
|---|---|---|---|
| CNF-A | 3'15" | 323 | 0.58 |
| CNF-B | 3'15" | 323 | 0.68 |
| CNF-C | 1'45" | 276 | 0.36 |
| CNF-D | 1'45" | 276 | 0.55 |

Table VI indicates that Films CNF-A and CNF-B have identical red inertial speeds, but Film CNF-B has a 17% higher lower scale red gamma. Films CNF-C and CNF-D show an expected red speed loss resulting from a shorter development time. However, at the shorter process time, Film CNF-D produced a lower scale red gamma within 5% of Film CNF-A, whereas Film CNF-C produced an unacceptably low red gamma.

From Table VI it is apparent that substituting AgBr grains containing a Group 8 dopant for AgIBr grains in the fast and mid red emulsion layers cost nothing in terms of speed, but created increased lower scale red contrast, which is determined by these faster emulsion layers. Surprisingly, the contrast of CNF-D processed at a reduced development time is very nearly equal to that of CNF-A containing AgIBr emulsions in the red recording layer unit and processed at the standard development time of 3' 15". The ability of CNF-D to deliver a near optimum lower scale contrast at a development time of less than 2 minutes was entirely unexpected.

The step tablet exposures for the Films CNF-A, CNF-B, CNF-C and CNF-D were also measured for granularity using a densitometer with a 48 $\mu$m aperture. The raw red granularity values (Sd×1000) for each film at several log exposure steps which encompass the underexposure range for these films are recorded and compared in Table VII below. Assuming that a 5% difference in Sd=1 grain unit, red grain unit differences for each film at the processing times indicated are listed in Table VII.

TABLE VII

Red Granularity Comparison

| Film | Development Time | Sd × 1000 at Exposure Step 15 | 13 | 11 | 9 |
|---|---|---|---|---|---|
| CNF-A | 3'15" | 12.17 | 13.23 | 13.02 | 11.58 |
| CNF-B | 3'15" | 14.13 | 17.10 | 17.13 | 16.07 |
| Diff. in Grain Units = | | +3.0 | +5.2 | +5.6 | +6.7 |
| CNF-C | 1'45" | 4.27 | 5.30 | 5.72 | 5.90 |
| CNF-D | 1'45" | 4.68 | 5.32 | 6.96 | 7.85 |
| Diff. in Grain Units = | | +1.8 | +0.1 | +4.0 | +5.8 |

From Table VII, it is apparent that Film CNF-B shows an average +5.1 grain unit penalty for red underexposures as compared to Film CNF-A when both films are normally processed. This penalty is slightly greater than the +3.4 grain unit penalty expected due to the 17% higher red gamma of Film CNF-B.

In the rapid process, Film CNF-D shows an average +2.9 grain unit penalty as compared to Film CNF-C. However, this grain penalty is unexpectedly much lower than the +7.0 grain unit penalty expected due to the 35% lower red gamma of Film CNF-C. In other words, there is no speed or granularity penalty for substituting AgBr red recording grains with Group 8 dopant for AgIBr grains, and on a gamma normalized basis, the red image obtained actually exhibits lower than expected granularity.

GLOSSARY OF ACRONYMS

S-1 = Tritolyl phosphate

S-2 = Dibutyl phthalate

S-3 = N, N-Diethyldodecanamide

S-9 = 1, 4-Cyclohexyldimethylene bis(2-ethylhexanoate)

UV-7

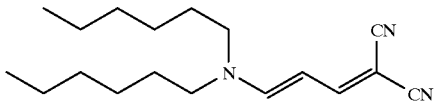

UV-8

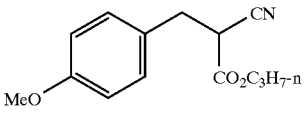

-continued
B-1
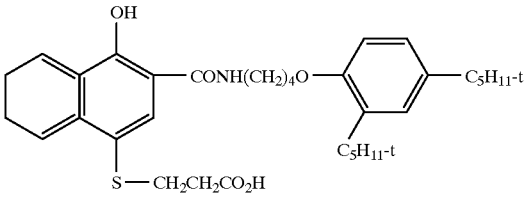
Y-14
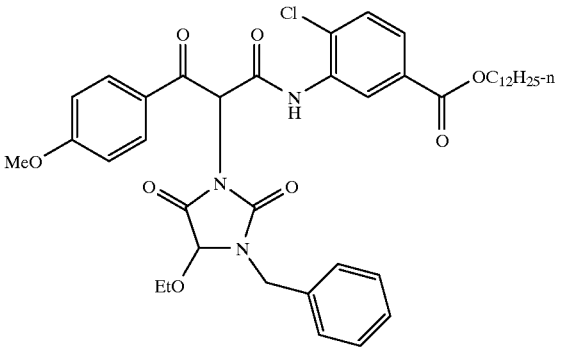
Y-15
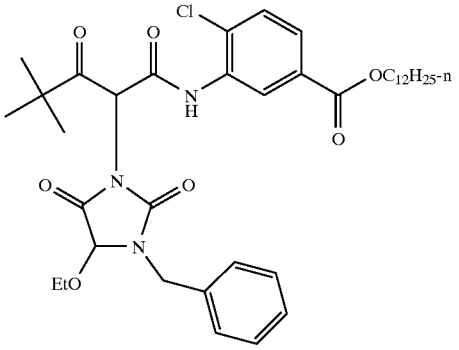
DYE 4
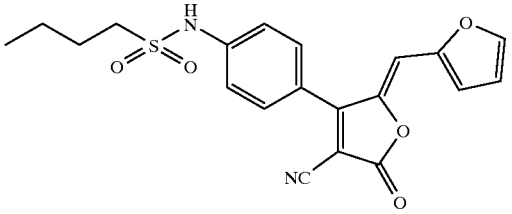
DYE 5
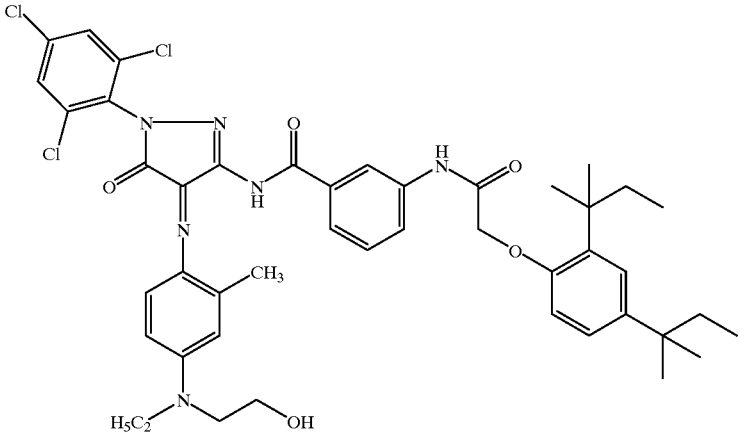

-continued
DYE 6
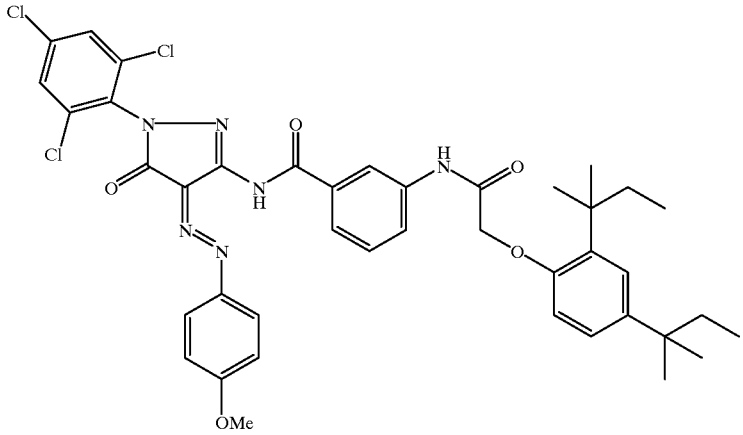
DYE 7
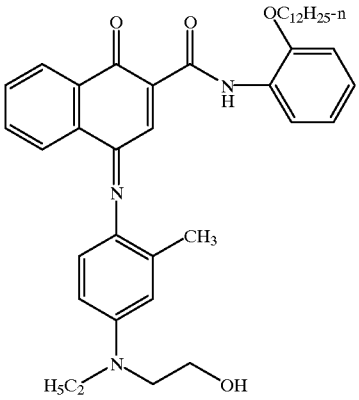
C-2
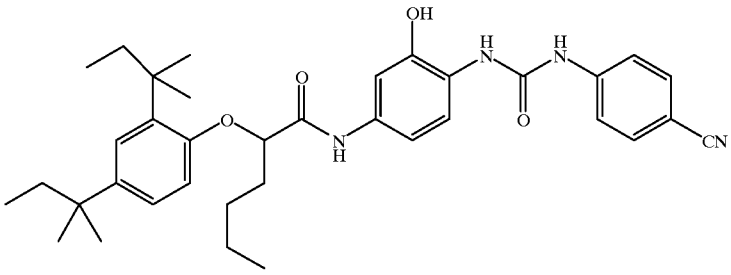
C-12
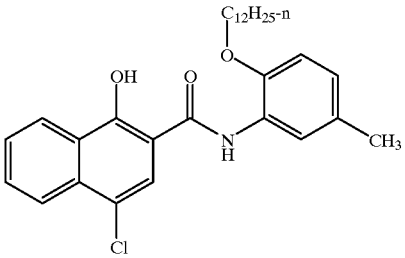
C-22
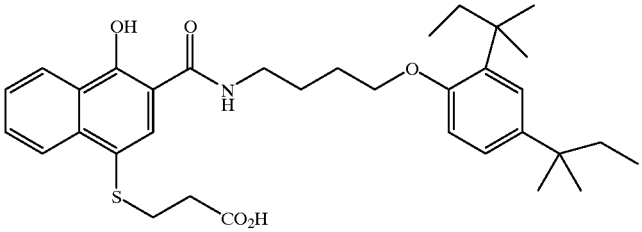

-continued
D-3
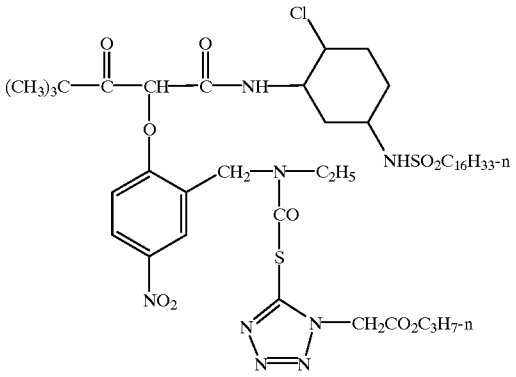
D-4
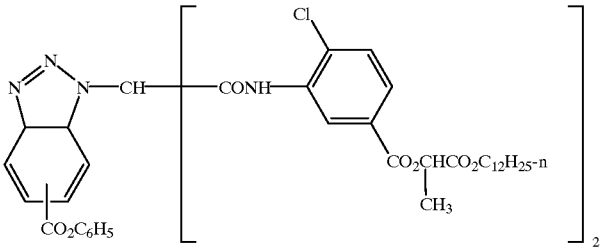
D-5
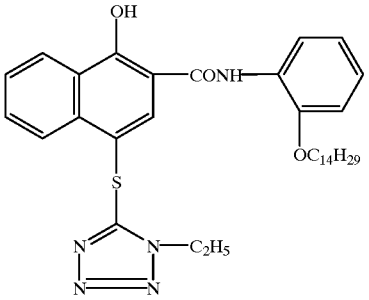
ST-4
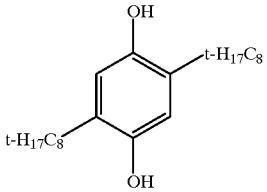
ST-5
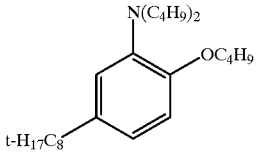

-continued

M-5

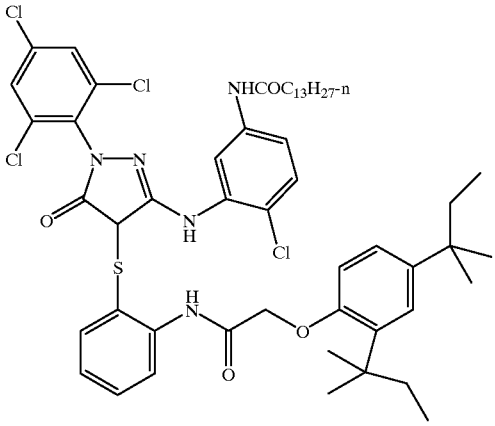

MC-1

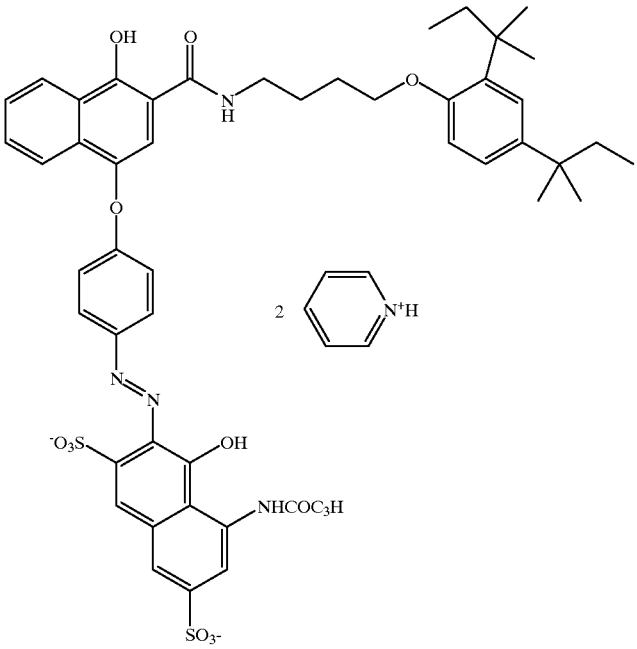

MC-2

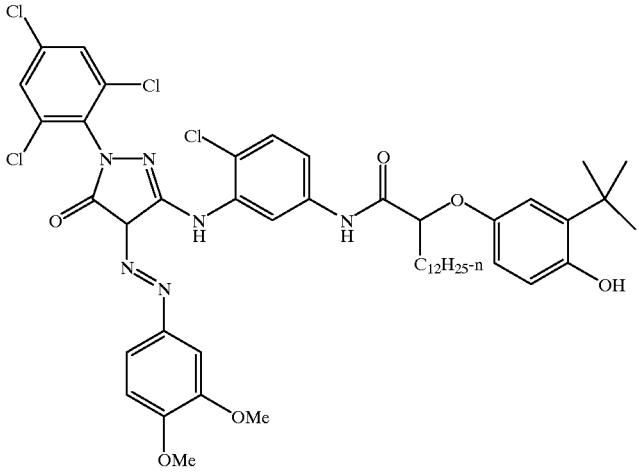

The invention has been described in detail with particular reference to preferred embodiments thereof, but it will be understood that variations and modifications can be effected within the spirit and scope of the invention.

What is claimed is:

1. A photographic element capable of producing a color negative image comprised of a transparent film support and, coated on the support, a first recording layer unit, containing blue sensitive silver halide grains and yellow dye-forming coupler, located to receive exposing radiation prior to all other recording layer units, a second recording layer unit, containing green sensitized silver halide grains and magenta dye-forming coupler, located to receive exposing radiation from the first recording layer unit, and a third recording layer unit, containing red sensitized silver halide grains and cyan dye-forming coupler, located to receive exposing radiation from the second recording layer unit,

WHEREIN, the first and second recording layer units contain silver halide grains that are comprised of greater than 50 mole percent bromide and from 1 to 10 mole percent iodide, based on silver, and the third recording layer unit contains silver halide grains that are comprised of greater than 50 mole percent bromide and less than 0.05 mole percent iodide, based on silver, and at least $1\times10^{-6}$ mole per silver mole of a hexacoordination complex of a Group 8 metal and coordination ligands, at least four of the ligands being anionic and at least one of the ligands being more electronegative than halide ligands.

2. A photographic element capable of producing a color negative image according to claim 1 wherein, the third recording layer unit contains a first emulsion layer located to receive exposing radiation from the second recording layer unit and a second emulsion layer located to receive exposing radiation from the first emulsion layer, the first and second emulsion layers containing silver halide grains that are comprised of greater than 50 mole percent bromide and less than 0.05 mole percent iodide, based on silver, and at least $1\times10^{-6}$ mole per silver mole of a hexacoordination complex of a Group 8 metal and coordination ligands, at least four of the ligands being anionic and at least one of the ligands being more electronegative than halide ligands.

3. A photographic element capable of producing a color negative image according to claim 2 wherein the third recording layer unit additionally contains a third emulsion layer located to receive exposing radiation from the second emulsion layer and contains red sensitized silver halide grains that are comprised of greater than 50 mole percent bromide and from 1 to 10 mole percent iodide, based on silver.

4. A photographic element capable of producing a color negative image according to claim 1 additionally including a fourth recording layer unit, containing green sensitized silver halide grains and magenta dye-forming coupler, located to receive exposing radiation from the third recording layer unit, and a fifth recording layer unit, containing red sensitized silver halide grains and cyan dye-forming coupler, located to receive exposing radiation from the red recording layer unit,

WHEREIN, the first, second and fourth recording layer units contain silver halide grains that are comprised of greater than 50 mole percent bromide and from 1 to 10 mole percent iodide, based on silver, and the third and fifth recording layer units contain silver halide grains that are comprised of greater than 50 mole percent bromide and less than 0.05 mole percent iodide, based on silver, and at least $1\times10^{-6}$ mole per silver mole of a hexacoordination complex of a Group 8 metal and coordination ligands, at least four of the ligands being anionic and at least one of the ligands being more electronegative than halide ligands.

5. A photographic element capable of producing a color negative image according to claim 4 additionally including;

a sixth recording layer unit, containing green sensitized silver halide grains and magenta dye-forming coupler, located to receive exposing radiation from the fifth recording layer unit, and a seventh recording layer unit, containing red sensitized silver halide grains and cyan dye-forming coupler, located to receive exposing radiation from the sixth recording layer unit,

WHEREIN, the sixth and seventh recording layer units contain silver halide grains that are comprised of greater than 50 mole percent bromide and from 1 to 10 mole percent iodide, based on silver.

6. A photographic element capable of producing a color negative image according to claim 1 wherein at least five of the coordination ligands are more electronegative than halide ligands.

7. A photographic element capable of producing a color negative image according to claim 1 wherein the Group 8 metal is ruthenium or osmium and at least 3 of the coordination ligands are more electronegative than halide ligands.

8. A photographic element capable of producing a color negative image comprised of;

a transparent film support and, coated on the support, a first recording layer unit, containing blue sensitive silver halide grains and yellow dye-forming coupler, located to receive exposing radiation prior to all other recording layer units, a second recording layer unit, containing green sensitized silver halide grains and magenta dye-forming coupler, located to receive exposing radiation from the first recording layer unit, and a third recording layer unit, containing red sensitized silver halide grains and cyan dye-forming coupler, located to receive exposing radiation from the second recording layer unit,

WHEREIN, the first and second recording layer units contain silver iodobromide grains that are comprised of from 1 to 10 mole percent iodide, based on silver, and the third recording layer unit contains a first emulsion layer located to receive exposing radiation from the second recording layer unit and a second emulsion layer located to receive exposing radiation from the first emulsion layer, the first and second emulsion layers containing silver bromide grains that contain at least $1\times10^{-6}$ mole per silver mole of a hexacoordination complex of a Group 8 metal and at least five cyano coordination ligands.

9. A process of producing a color negative image comprised of developing an imagewise exposed photographic element in 2 minutes or less at a temperature of less than 40° C. to create a silver image and yellow, magenta and cyan dye images, bleaching the silver image, and fixing to remove silver halide, the imagewise exposed photographic element being comprised of a transparent film support and, coated on the support, a first recording layer unit, containing blue sensitive silver halide grains and yellow dye-forming coupler, located to receive exposing radiation prior to all other recording layer units, a second recording layer unit, containing green sensitized silver halide grains and magenta dye-forming coupler, located to receive exposing radiation from the first recording layer unit, and a third recording layer unit, containing red sensitized silver halide grains and cyan dye-forming coupler, located to receive exposing radiation from the second recording layer unit,

WHEREIN, the first and second recording layer units contain silver halide grains that are comprised of greater than 50 mole percent bromide and from 1 to 10 mole percent iodide, based on silver, and the third recording layer unit contains silver halide grains that are comprised of greater than 50 mole percent bromide and less than 0.05 mole percent iodide, based on silver, and at least $1\times10^{-6}$ mole per silver mole of a hexacoordination complex of a Group 8 metal and coordination ligands, at least four of the ligands being anionic and at least one of the ligands being more electronegative than halide ligands.

* * * * *